US008689530B2

(12) United States Patent
Prahm et al.

(10) Patent No.: US 8,689,530 B2
(45) Date of Patent: Apr. 8, 2014

(54) METHOD AND DEVICE FOR INSERTING (TUBE) BAGS INTO CARTONS

(75) Inventors: Andreas Prahm, Barβel (DE); Mimke Bohlen, Groβefehn (DE); Frank Sachs, Saterland (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 361 days.

(21) Appl. No.: 12/918,076

(22) PCT Filed: Feb. 10, 2009

(86) PCT No.: PCT/EP2009/000908

§ 371 (c)(1),
(2), (4) Date: Sep. 30, 2010

(87) PCT Pub. No.: WO2009/103441

PCT Pub. Date: Aug. 27, 2009

(65) Prior Publication Data

US 2011/0005174 A1 Jan. 13, 2011

(30) Foreign Application Priority Data

Feb. 21, 2008 (DE) ..... 10 2008 010 432

(51) Int. Cl.
*B65B 5/10* (2006.01)
*B65B 5/02* (2006.01)
*B65B 43/24* (2006.01)

(52) U.S. Cl.
USPC ..... 53/475; 53/447; 53/247; 53/249; 53/564; 53/566

(58) Field of Classification Search
USPC ..... 53/475, 447, 566, 564, 247, 249
See application file for complete search history.

(56) References Cited

U.S. PATENT DOCUMENTS

| | | | | |
|---|---|---|---|---|
| 3,488,917 | A * | 1/1970 | Eitl et al. | 53/245 |
| 3,932,982 | A * | 1/1976 | Klapp | 53/244 |
| 3,941,037 | A * | 3/1976 | Reichert | 493/167 |
| 4,062,168 | A * | 12/1977 | Watts et al. | 53/64 |
| 4,081,096 | A * | 3/1978 | Kupcikevicius | 53/473 |
| 4,414,789 | A * | 11/1983 | Pattarozzi | 53/566 |
| 4,492,070 | A * | 1/1985 | Morse et al. | 53/438 |

(Continued)

FOREIGN PATENT DOCUMENTS

JP S55-038753 U 3/1980

OTHER PUBLICATIONS

Japanese Patent Office, Official Action for Japanese Patent Application No. 2010-547080, issued on Nov. 12, 2012, mailed on Dec. 4, 2012.

*Primary Examiner* — Hemant M Desai
*Assistant Examiner* — Gloria R Weeks
(74) *Attorney, Agent, or Firm* — Laurence P. Colton; Smith Risley Tempel Santos LLC

(57) ABSTRACT

In order to insert packages, particularly bags (10) having fragile packaging goods into containers or cartons (14), the carton (14) is held ready in a packing station (16) such that the bags (10) can be inserted into the carton (14) by means of a delivery device, particularly a pusher (56). In order to create different, ordered formations of the bags (10) within the carton (14), said carton can be moved during the filling or packing process such that the packing formation is created due to a corresponding relative positioning of the carton (14) at a predetermined feed plane.

24 Claims, 11 Drawing Sheets

(56) References Cited

U.S. PATENT DOCUMENTS

| | | | | | |
|---|---|---|---|---|---|
| 4,600,065 | A | * | 7/1986 | Morris | 177/123 |
| 4,608,808 | A | * | 9/1986 | Ryan et al. | 53/436 |
| 4,633,653 | A | * | 1/1987 | Roberts et al. | 53/498 |
| 4,862,677 | A | * | 9/1989 | Roberts et al. | 53/498 |
| 4,905,456 | A | * | 3/1990 | Olaechea | 53/446 |
| 4,942,720 | A | * | 7/1990 | Berney | 53/447 |
| 5,012,628 | A | * | 5/1991 | Van Oord | 53/448 |
| 5,027,586 | A | * | 7/1991 | Ramaker | 53/458 |
| 5,159,796 | A | * | 11/1992 | Tas | 53/245 |
| 5,352,178 | A | | 10/1994 | Pazdernik | |
| 5,426,921 | A | * | 6/1995 | Beckmann | 53/566 |
| 5,445,590 | A | * | 8/1995 | Pazdernik | 493/317 |
| 5,502,949 | A | * | 4/1996 | Main et al. | 53/448 |
| 5,542,238 | A | | 8/1996 | Johnson et al. | |
| 5,558,614 | A | | 9/1996 | Anderson et al. | |
| 5,588,285 | A | * | 12/1996 | Odenthal | 53/534 |
| 5,732,536 | A | * | 3/1998 | Lin et al. | 53/535 |
| 5,778,640 | A | * | 7/1998 | Prakken et al. | 53/475 |
| 5,855,105 | A | * | 1/1999 | Ferris | 53/475 |
| 5,896,728 | A | * | 4/1999 | Domino et al. | 53/458 |
| 6,694,706 | B1 | * | 2/2004 | Odenthal et al. | 53/443 |
| 7,096,650 | B2 | * | 8/2006 | Van Dam | 53/540 |
| 7,137,234 | B2 | * | 11/2006 | Caporali et al. | 53/433 |
| 7,328,561 | B2 | * | 2/2008 | Fochler | 53/564 |
| 7,475,520 | B2 | * | 1/2009 | Swider et al. | 53/55 |
| 7,856,797 | B2 | * | 12/2010 | Black et al. | 53/447 |
| 8,015,782 | B2 | * | 9/2011 | Borderi et al. | 53/537 |
| 8,316,624 | B2 | * | 11/2012 | Prakken | 53/447 |
| 2003/0120387 | A1 | * | 6/2003 | Sherwin | 700/245 |
| 2006/0117714 | A1 | * | 6/2006 | Draghetti | 53/458 |

* cited by examiner

*Fig. 7*
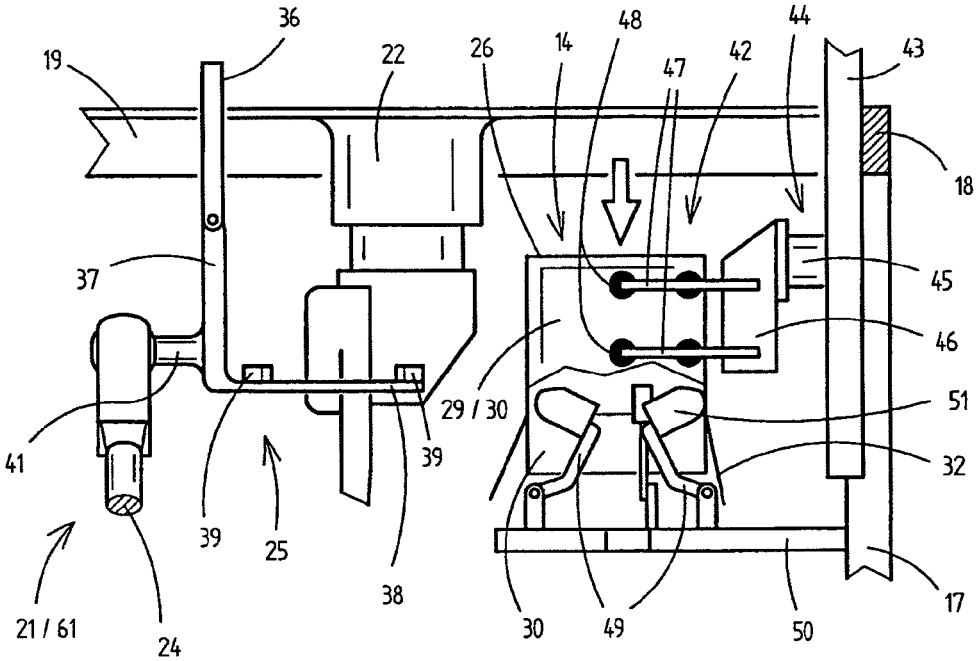
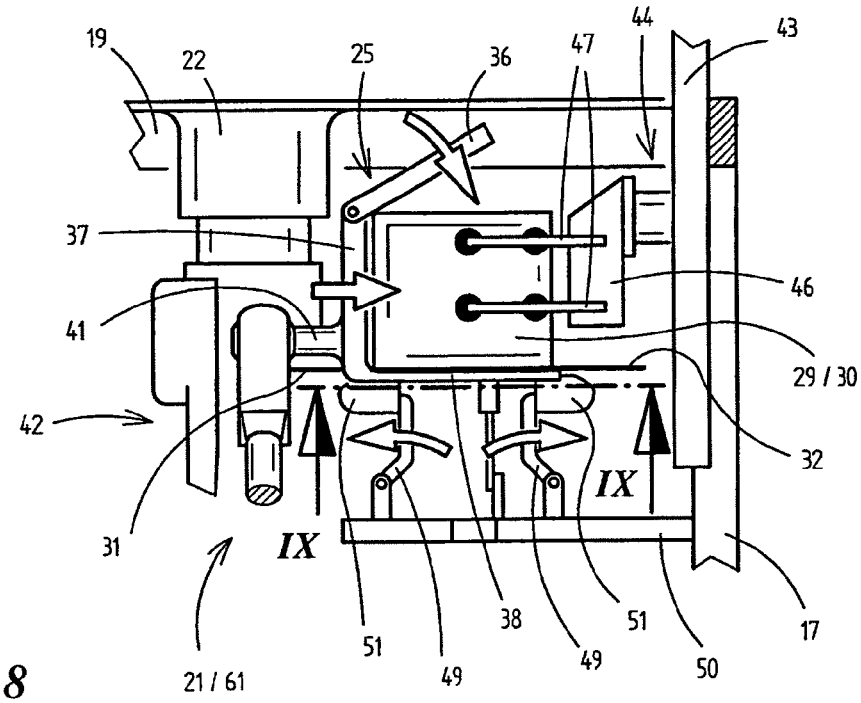
*Fig. 8*

*Fig. 14*
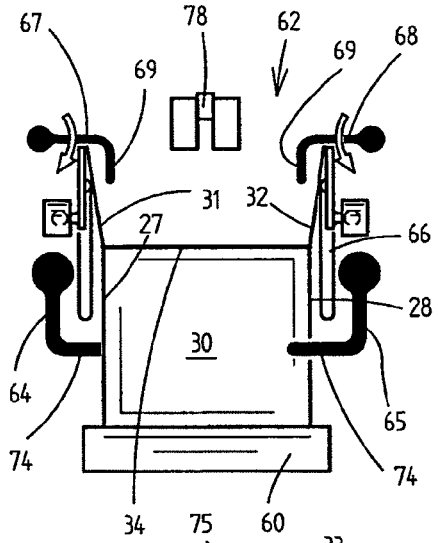
*Fig. 15*
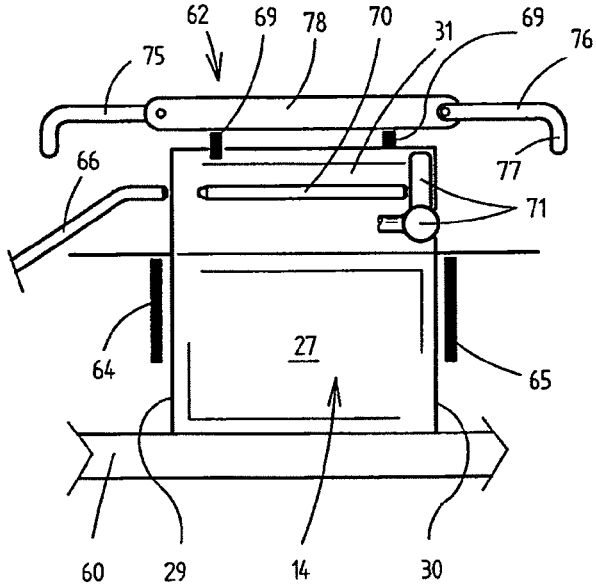
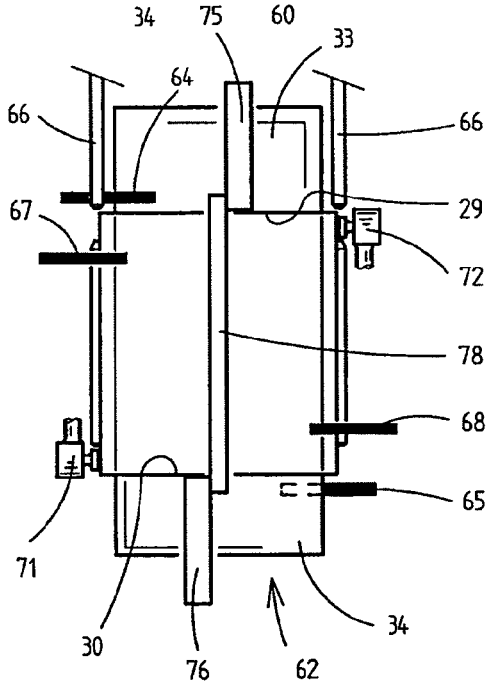
*Fig. 16*

*Fig. 17*
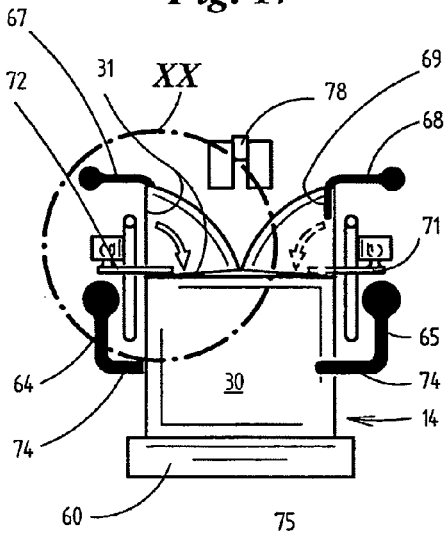
*Fig. 18*
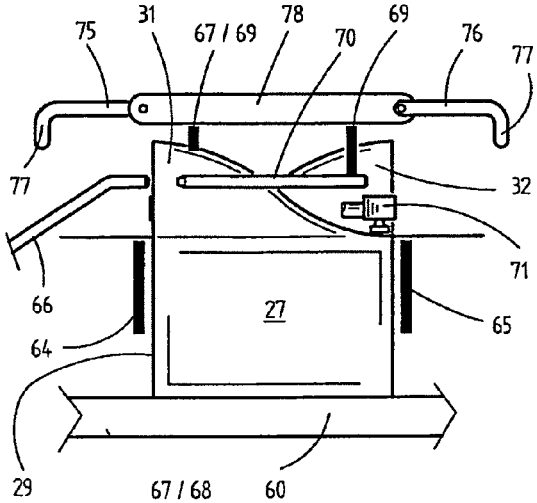
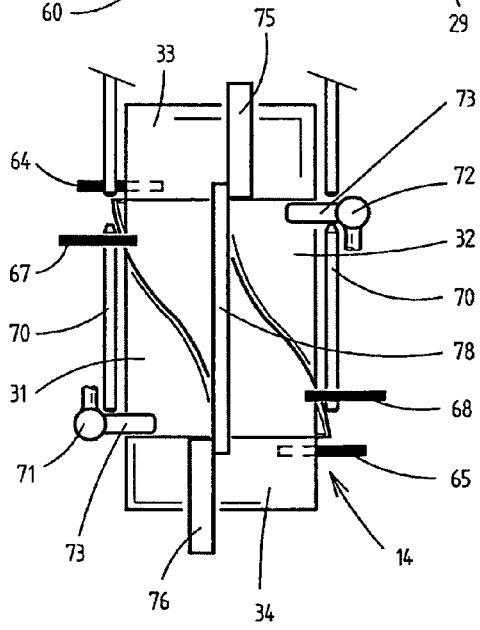
*Fig. 19*
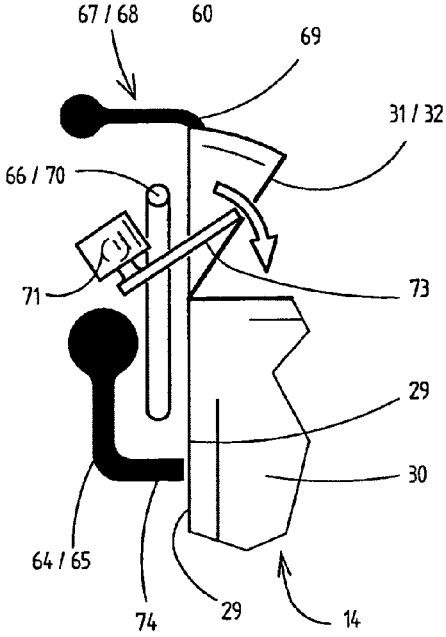
*Fig. 20*

*Fig. 21*
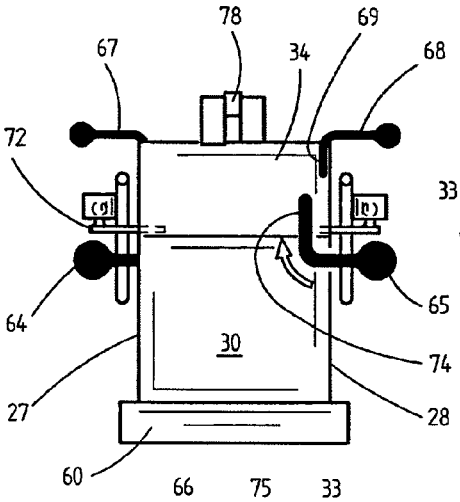
*Fig. 22*
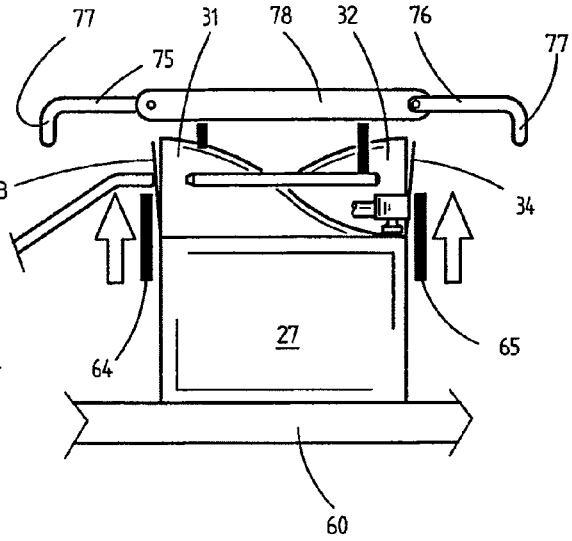
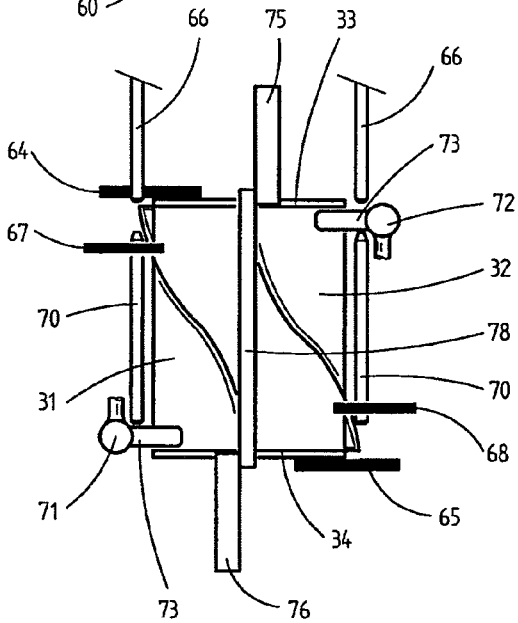
*Fig. 23*

*Fig. 24*
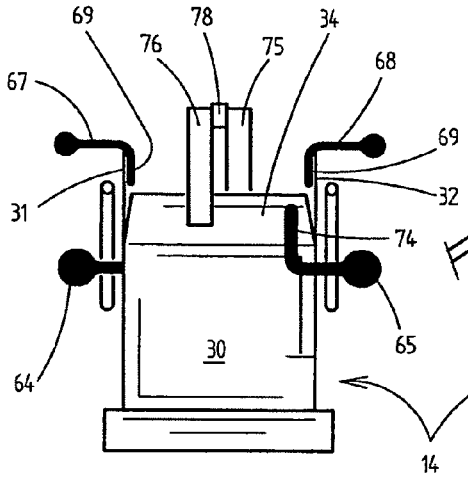
*Fig. 25*
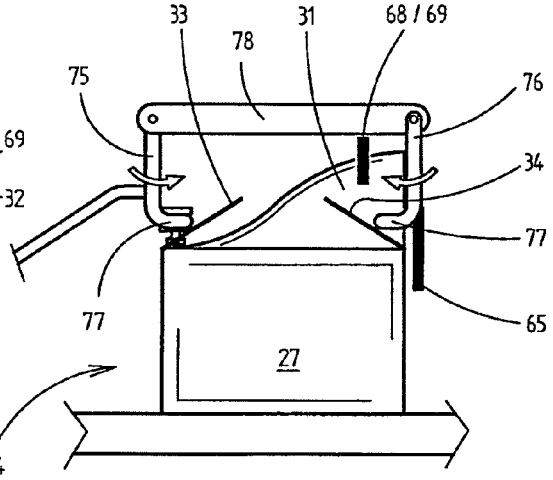
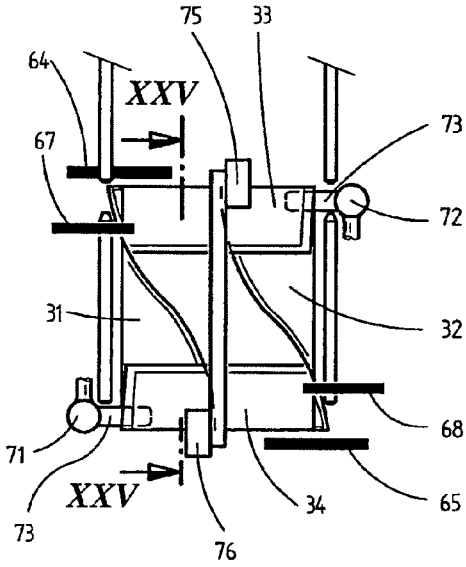
*Fig. 26*
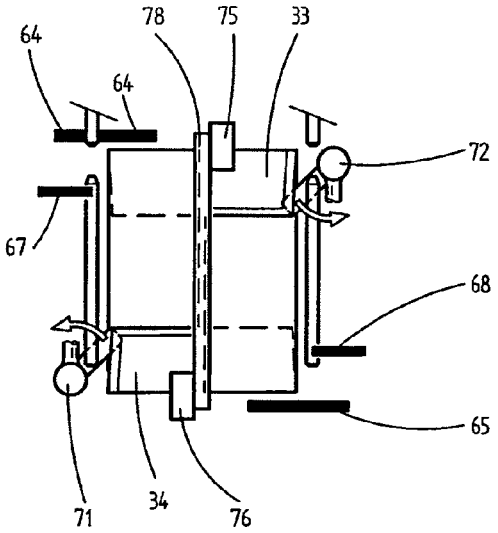
*Fig. 27*

METHOD AND DEVICE FOR INSERTING (TUBE) BAGS INTO CARTONS

STATEMENT OF RELATED APPLICATIONS

This patent application is the Patent Cooperation Treaty Chapter II National Phase of Patent Cooperation Treaty International Patent Application No. PCT/EP2009/000908 having an International Filing Date of 10 Feb. 2009, which is incorporated herein in its entirety by this reference.

BACKGROUND OF THE INVENTION

The invention relates to a method for the introduction of items into a container, especially packs such as (tube) bags into a carton, involving the creation of an ordered formation of the items or packs inside the container or carton, the items or packs being fed on a feed conveyor individually one after the other or in (small) groups to a filling station and being introduced into the container or carton that is open on at least one side.

BRIEF SUMMARY OF THE INVENTION

The invention is concerned primarily with the filling of (tube) bags with fragile consumer goods such as (potato) chips into shipping cartons. The pillow-shaped bags are positioned in a predetermined formation, that is to say in rows, layers, etc., inside the carton.

Because of the different size of the items, especially bags, and/or because of the different dimensions of the cartons, it is necessary to provide different formations of the bags inside the carton, taking into account the given dimensions, so that optimal filling is assured.

The object of the invention is accordingly to configure the introduction of items into containers, especially bags into cartons, in such a way that the formation of the items/bags inside the carton can be changed by simple means involving its adaptation to the predetermined dimensions at the same time associated with gentle handling of the contents of the pack. A further object of the invention is to improve the process of closing the filled carton.

In order to achieve this object, the method according to the invention is characterized in that, for the purpose of filling the items or packs, the container or carton is capable of movement into a relative position corresponding to the formation to be produced.

The invention is accordingly based on the assumption that the items or bags to be packed are held ready in a predetermined position in the packing station, and that the container or carton is brought into a relative position which corresponds to the formation to be produced, for example an upright longitudinal row, a transverse row or a position in which the bags are lying flat. The procedure adopted according to the invention is for the carton to change its relative position a number of times during a filling phase, as appropriate, in order to permit complex, but ordered, formations of the bags inside the carton without changing the position of the bags during the filling process. For the purpose of introducing the bags into the carton, according to the invention the bags are introduced into the carton lying flat on a feed plane that is preferably inclined in the direction of the carton opening with the bag in a predetermined relative position.

The device according to the invention is equipped in the vicinity of the filling station with at least one handling unit, which brings about the different relative positions of the carton that is open on one side corresponding to the formation of the filling to be produced. Provided in particular for this purpose is a robot with a holding head for gripping the carton and for executing the movements for different relative positions.

An additional handling unit for the cartons, and especially an additional robot, are provided in order to increase the operating output. The two robots are positioned in such way inside a common machine frame that they alternately pick up cartons in the vicinity of a carton station and feed them to the filling station. The filled cartons are placed on a carton conveyor by the robots.

The invention is also concerned with the further processing of the filled cartons, and especially with measures for closing the cartons involving the folding of folding flaps in such a way that these are arranged in a fanfold formation.

BRIEF DESCRIPTION OF THE DRAWINGS

Further characterizing features and details of the invention are explained below in greater detail with reference to the drawings, in which:

FIG. 7 depicts a detail of the device in a representation analogous to FIG. 6, on an enlarged scale;

FIG. 8 depicts the detail according to FIG. 7 with a changed relative position of the devices;

FIG. 14 depicts a detail of a closing station for cartons in a transverse view corresponding to sectional plane XIV-XIV in FIG. 4;

FIG. 15 depicts the detail according to FIG. 14 in a side view;

FIG. 16 depicts the detail according to FIG. 14 in a top view according to the arrow 16 in FIG. 4;

FIG. 17 to FIG. 19 depict representations of FIG. 14 to FIG. 16 with folding flaps of the carton in different folding positions;

FIG. 20 depicts a detail XX of FIG. 17 on an enlarged scale; and

FIG. 21 to FIG. 27 depict different representations of the folding step for the folding flaps of the carton analogous to FIG. 17 to FIG. 19.

DETAILED DESCRIPTION OF PREFERRED EMBODIMENTS

Figure 1:
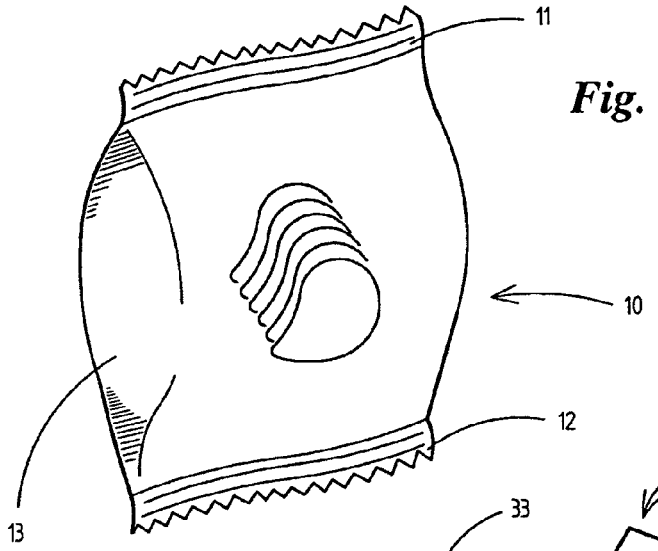
FIG. 1 depicts a (tube) bag as an example of an item to be processed in a perspective view.

The examples in the drawings are concerned with the handling of bags 10 made of foil in an embodiment as a tube bag.

This consists of a tube section of the packaging material with upper and lower closure seams 11, 12. This bag 10 is executed in addition with gusset folds 13. The bag 10 is intended to receive different products. In the present case, the bags 10 are used to receive potato chips, for example, i.e. fragile products.

Figure 2:
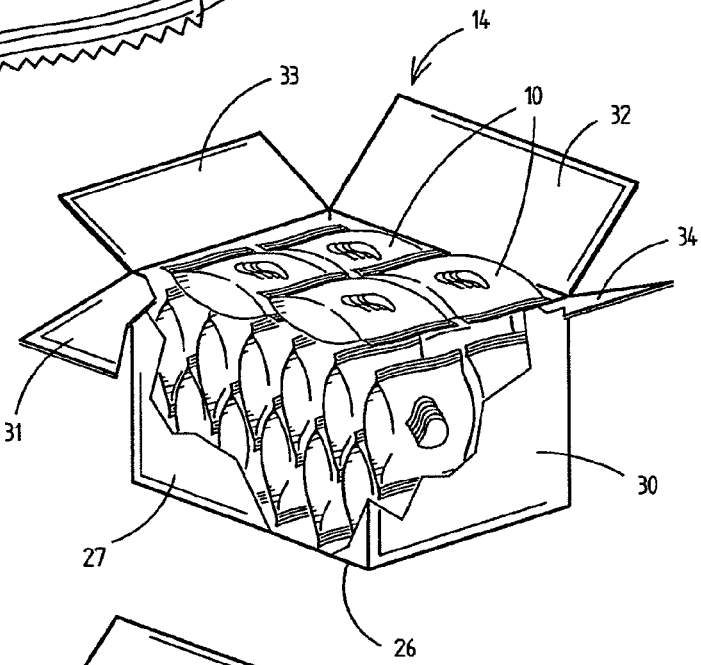
FIG. 2 depicts a carton as a container intended to receive bags according to FIG. 1 in a predetermined formation, also in a perspective view.
Figure 3:
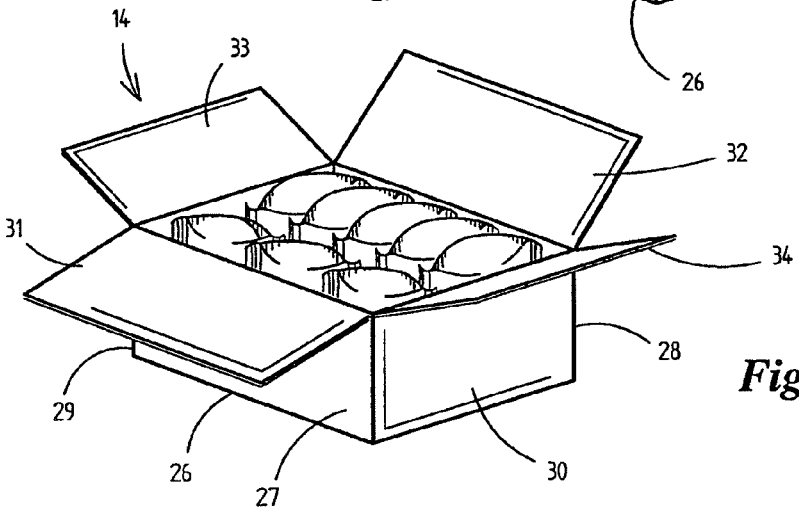
FIG. 3 depicts a second embodiment of the formation of bags inside a carton.
Figure 4:
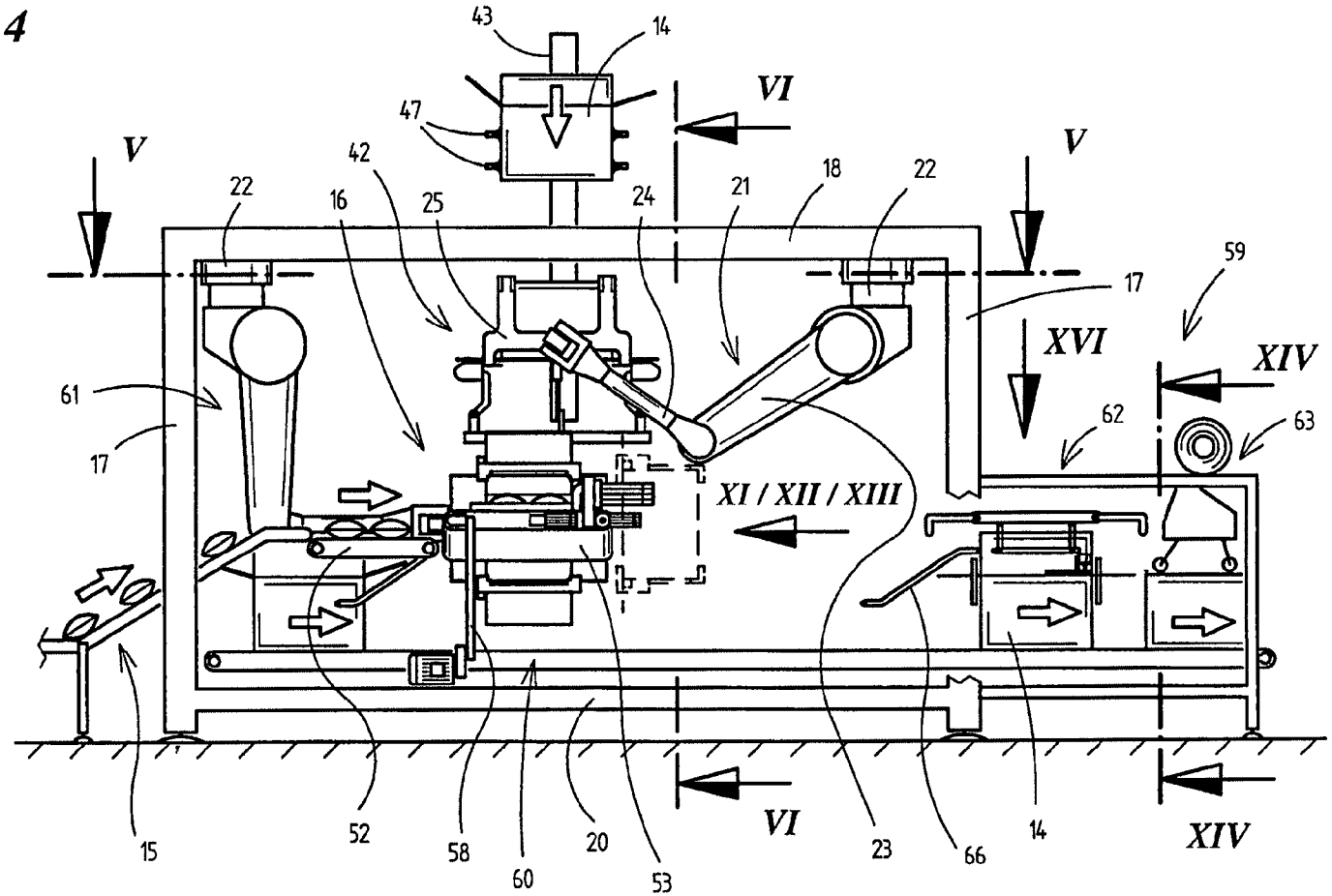
FIG. 4 depicts a device with a filling station and a closing station for cartons in a simplified side view.

An important consideration is the introduction of the bags 10 into a container, in this case into a (folding) carton 14. A number of bags 10 is positioned inside the carton 14 in an ordered formation. The intention is to fill cartons 14 of different sizes completely with bags 10 and/or to position them properly having regard for the product, the bags 10 also being capable of exhibiting different dimensions. In the example according to FIG. 2, the bags 10 are arranged in two lower rows in an upright orientation and are offset in relation to one another from row to row, together with one upper flat row. The carton 14 according to FIG. 3 the bags 10 are arranged adjacent to one another in two rows, the bags in one row being oriented transversely, and the bags in the other row being oriented longitudinally. A plurality of other formations is possible in order to adapt on the one hand to the size of the bags 10 and on the other hand to that of the carton 14 to be filled.

The bags 10 are introduced into the cartons 14 by mechanical means, that is to say by appropriate filling devices, in order to produce the one or the other formation. For this purpose, the bags 10 arriving from a bag packer (not illustrated here), for example, are fed one after the other, in this case separated by a distance, onto a feed conveyor 15 of a packing station 16. In the region of the latter, bags 10 are introduced one after the other (and also as small groups in each case with a number of bags 10 arranged adjacent to and/or above one another) into a waiting carton 14, simultaneously producing the one or the other ordered formation. In the packing station 16, the bags 10 are made available on a predefined introduction plane and are introduced into the open carton 14. The positions of the bags 10 inside the carton 14—depending on the formation to be produced—are brought about by the variable relative position of the carton 14. The carton is accordingly positioned in such a way that, as the bags 10 enter the carton 14, the required relative position corresponding to the formation to be produced is adopted. The carton 14 is capable of being moved for this purpose in the vicinity of the packing station 16, that is to say it can be rotated, tilted and displaced in all directions.

The packing station 16 is present together with the associated devices and units inside a linear machine frame with upright supports 17, upper longitudinal beams 18 and transverse beams 19. Lower longitudinal members 20 for connecting the supports 17 are provided in order to stabilize a frame structure of this configuration.

At least one handling device is assigned to the packing station 16 for the purpose of holding and moving the carton 14 during filling. In the case of the present illustrative embodiment, a (first) robot 21 is provided as a handling device. This is a six-axis robot, which is mounted in an upper swivel 22 on a supporting element of the machine frame. The robot 21 is capable of rotating about a vertical axis in the vicinity of the swivel 22. Two articulated arms 23, 24 form a boom for the robot 21. A holding head 25 is installed on the handling device or at the end of the articulated arm 24. This head is configured in such a way that an (open) carton 14 can be gripped. The holding head 25 is capable of movement in such a way that the for the filling of the carton 14 with a predetermined formation of the bags 10 is able to take place automatically.

The carton 14 consists as standard of one bottom wall 26 (consisting of folding flaps), two mutually opposing (upright) longitudinal walls 27, 28, two transversely oriented transverse walls 29, 30 and closing flaps, that is to say longitudinal flaps 31, 32 and transverse flaps 33, 34 on the upper side of the carton 14.

The holding head 25 of the handling device is configured in such a way that the open carton 14 is kept stable and the folding flaps 31, 32, 33, 34 are fixed preferably in the open position or the spread position. Furthermore, the holding head 25 is configured in such a way that at least one main area of an (upper) open side of the carton 14 is free for the introduction of the bags 10.

Figure 10:
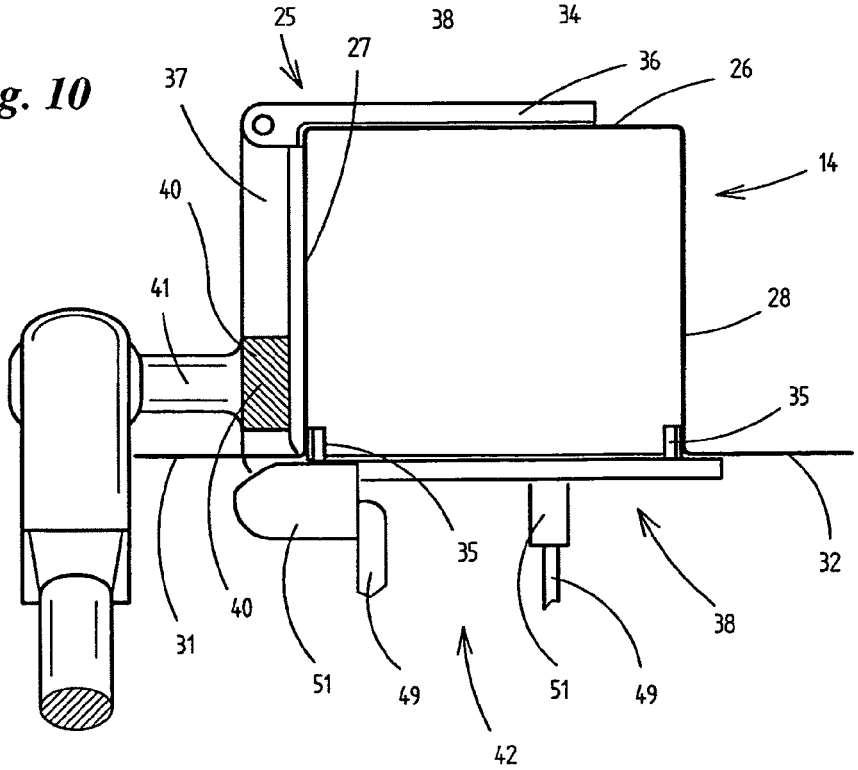
FIG. 10 depicts the detail according to FIG. 9 as a vertical section corresponding to sectional plane X-X in FIG. 9, on an enlarged scale.

The holding head 25 in the present illustrative embodiment is of U-shaped configuration when viewed from the side (FIG. 10). A supporting element connected to the handling device or the robot 21 exhibits transversely oriented holding devices, which grip the carton 14 on two opposing sides, in the present case on the (downward-facing) open side and, opposite thereto, in the vicinity of the bottom wall 26. The holding head 25 subjects the carton 14 to a holding or clamping force, which produces a sufficient holding effect for the performance of the movements without causing mechanical damage to the carton 14.

The holding head 25 is rotatably connected to the robot 21 or its boom via a transversely oriented connection or via a transversely oriented shaft journal 41. The holding head 25 exhibits a supporting device connected to the robot 21, that is to say a transverse profile 40. The shaft journal 41 is positioned on this profile. Transversely oriented support legs 37 (in FIG. 7, FIG. 8 upright) are in turn positioned on both sides at the ends of the transverse profile 40. The supporting frame connected to the robot 21 is accordingly of H-shaped configuration when viewed from the side. The holding devices for gripping the carton 14 on mutually opposing sides are positioned at the free ends of the (two) support legs 37.

In the present illustrative embodiment, the carton 14 is held ready with downward-facing closure flaps 31, 32, 33, 34 in a carton station 42. A lower supporting device is configured as a projecting support arm 38, and two support arms 38, gripping the carton 14 along its edge are in fact provided, upon which the carton 14 is supported with free edges in the vicinity of the open side. Arranged in each case at the ends of the support arms 38 are angle pieces 39, which secure the associated closure flaps, in this case the longitudinal flaps 31, 32, in an open position or in a transversely oriented spread position. The transverse flaps 33, 34 are held in the open position by the support arms 38. The flaps 31, 32; 33, 34 are oriented horizontally.

Figure 11:
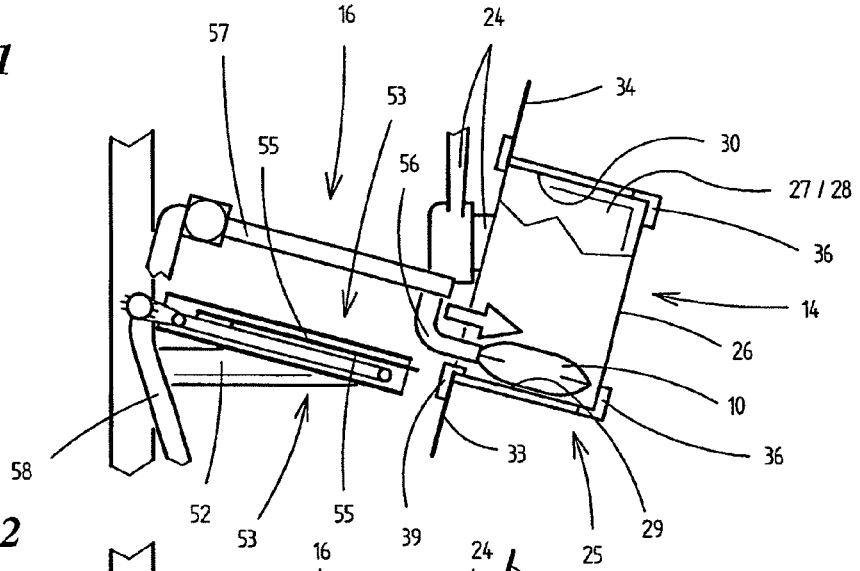
FIG. 11 to FIG. 13 depict different positions in the course of filling a carton in a side view corresponding to a part of the representation in FIG. 6.
Figure 12:
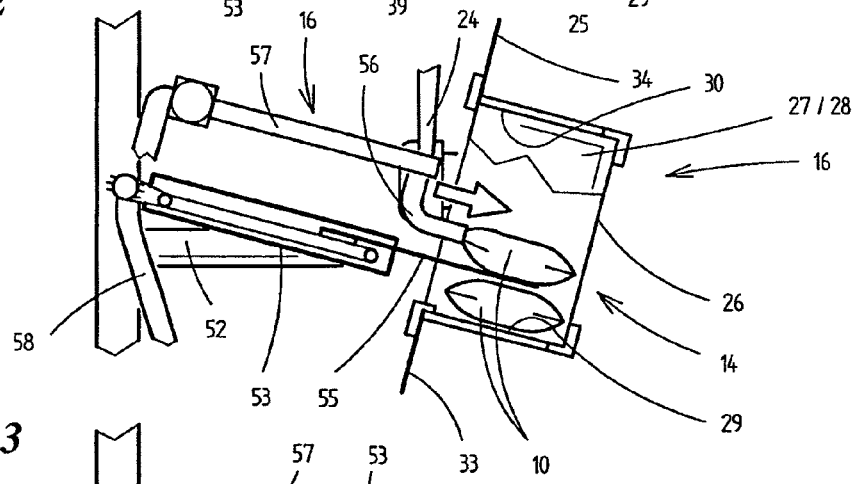
Figure 13:
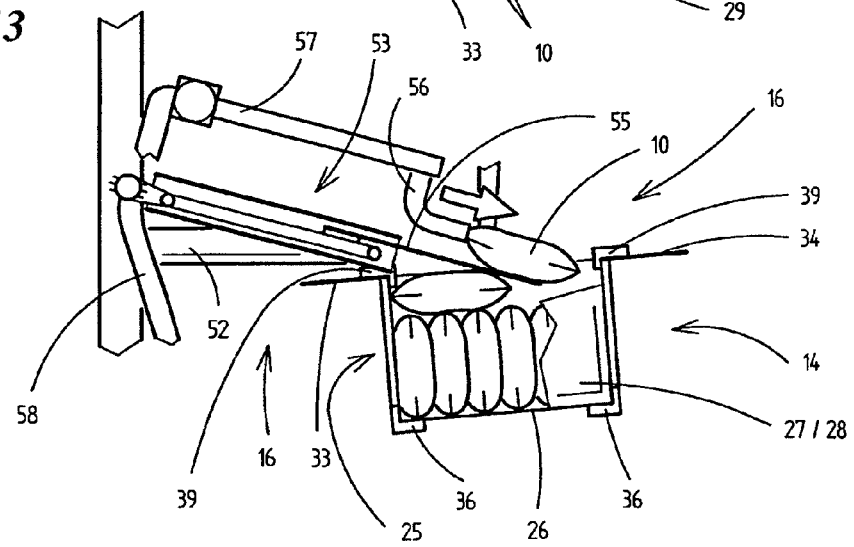

Corresponding, movable holding devices, especially folding legs 36, are arranged lying opposite the support arms 38. These are positioned on the upper ends of the support legs 37 (in the position ready to accept a carton 14 according to FIG. 10) and are in fact articulated, that is to say capable of pivoting. The upper, upright, initial position is illustrated in FIG. 7, and the holding position is illustrated in FIG. 10. The folding legs 36 are of angular configuration in their cross-section and grip the carton in the vicinity of the bottom wall and the side walls at the corners (FIG. 11 to FIG. 13). The mutually opposing angle pieces 39 are configured in such a way that they enter the carton 14 in the corner area with a leg 35. As a result, the carton 14 is held securely on the holding head 25 against movements in every direction.

The empty cartons 14 are supplied to the carton station 42 and are held ready there for gripping by the holding head 25 of the robot 21. The carton station 42 is arranged approximately in the middle of the machine frame. The empty cartons 14 are supplied with their open side facing upwards from a position above the machine frame, that is to say from above. A vertical conveyor for the cartons 14 is provided for this purpose in the vicinity of the carton station 42. In the present case, this is a servo axis 43, which is arranged in an upright position on the machine frame, in this case on a longitudinal beam 18. A servo axis is a familiar device for the linear transport of items. A sledge is capable of displacement inside a hollow profile, for example by means of a spindle. This is driven by a servo motor. A carton carrier 44 is capable of upward and downward movement on the servo axis, that is to say on its sledge (not illustrated here), and in addition it is capable of rotating about a swivel 45. The carton carrier 44 exhibits a (rotating) supporting element 46, on which there are arranged holding arms 47, which grip the carton 14 on both sides, in this case in the vicinity of the transverse walls 29, 30. Each holding arm 47 preferably exhibits a plurality of suction grippers 48, which grip and hold the carton 14 by means of a partial vacuum or suction air. The carton 14 is caused to rotate through 180° during the downward movement and, with its open side facing downwards, is set down on supporting elements in the vicinity of the carton station 42.

Before the carton 14 is picked up by the holding head 25 of the handling device, steps are taken to ensure that the closure flaps 31, 32, 33, 34 lie outside the carton 14. Folding devices enter the carton 14 for this purpose. Fixed folding levers 49 are arranged in the vicinity of the carton station 42. These are mounted in a pivoting fashion on a bracket 50 connected to the machine frame. The carton 14 is moved or placed over the inward-pivoted folding levers 49 in the course of the downward movement. The folding levers 49 exhibit transversely oriented folding heads 51. The movement of the folding levers 49 against the inside of the side walls of the carton 14 causes the transversely oriented, web-like folding heads 51 to arrive in the vicinity of approximately inward-folded folding flaps or closure flaps 31, 32, 33, 34 in contact with the side walls. The flap concerned is gripped and is caused to pivot outwards from the carton 14 by relative movement, especially by the upward movement of the carton 14. The folding heads 51 are arranged in such away that, as a consequence of their corresponding relative position, they grip a free, upward-facing edge of a closure flap 31, 32, 33, 34 remaining inside the carton 14 where appropriate. The upward and downward movement of the carton 14 occurring in this case is brought about by the carton carrier 44, which is thus utilized as a handling device for the carton 14 in the vicinity of the carton station 42.

Figure 9:
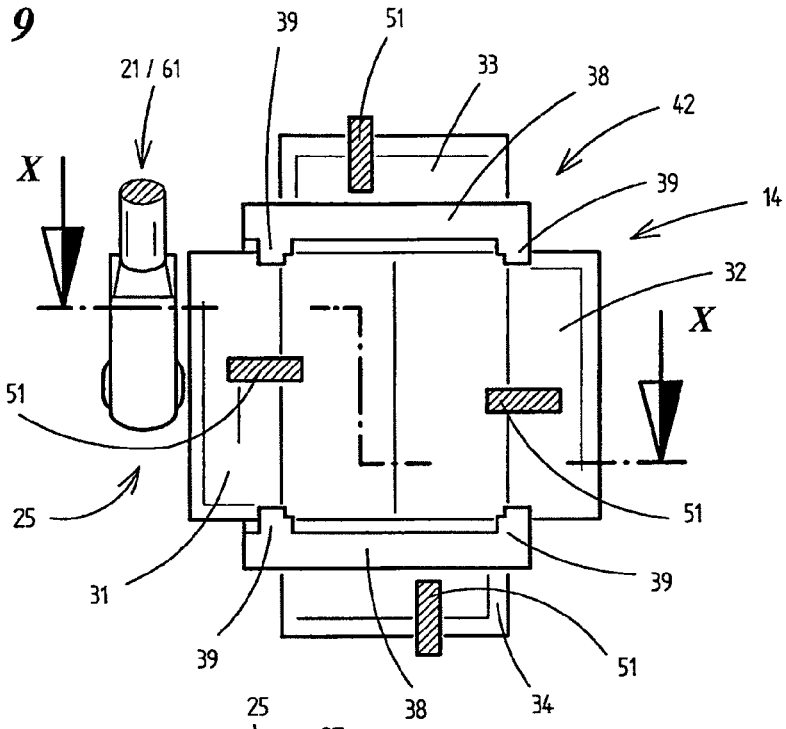
FIG. 9 depicts the detail according to FIG. 8 in a bottom view and as a horizontal section of the sectional plane IX-IX in FIG. 8.

Once all the folding flaps have been moved out of the carton 14 and—as in the present case—are facing downwards, the carton 14 is held ready in a transfer position for the robot 21. The outward-pivoted folding levers 49 are utilized together with the folding heads 51 as supporting devices for the carton 14 (FIG. 8, FIG. 9). The folding heads 51 are positioned in such a way, because of the corresponding position of the folding levers 49, that they are in contact with the formed edges of the carton 14, at least in the vicinity of the longitudinal flaps 31, 32, and act as a supporting device. Furthermore, the folding flaps 31, 32 are caused to move into a transversely oriented or horizontal position and are held in this position. The folding levers 49 arranged transversely hereto are arranged in such a way that they lie with the folding heads 51 outside the carton 14 and support only the folding flaps 33, 34 in a horizontal position.

The carton 14 is held in the carton station 42 in a predetermined relative position ready for take-up by the holding head 25. This is brought into position by horizontal movement with the folding leg 36 facing upwards. In the process, the carton 14 is fixed in position by a holding device. This task is undertaken in the present case by the carton carrier 44 with the holding arms 47. A relative movement may be necessary in conjunction with the take-up of the carton by the holding head 25, especially a downward movement of the carton 14 for the introduction of the legs 35 into the carton 14. This movement is also performed by an actuating device, in the present case by the carton carrier 44. After take-up of the carton 14 by the holding head 25, the holding arms 47 are released from the carton 14. The carton carrier 44 can now be moved in an upward direction ready for the take-up of the next carton 14.

The carton 14 is caused to move into the packing station 16 by the handling device or the robot 21. The open side of the carton 14 faces towards a filling unit for the introduction of the items or bags 10.

The packing station 16 exhibits a notably horizontally oriented intermediate conveyor 52 in conjunction with the feed conveyor 15. The bags 10 are also positioned and aligned in the vicinity thereof. Units or groups are formed as appropriate. In the present illustrative embodiment, two consecutive bags 10 in each case are collected on the intermediate conveyor 52 for common transfer to a carton 14. The bags 10 (either individually or as a group) are then transported to a transfer device arranged adjacent to the carton 14 or the carton opening.

The transfer device for introducing the bags 10 into the carton 14 consists essentially of a platform or a transfer belt 53. This adjoins the intermediate conveyor 52 in such a way that the individual or collected bags 10 are kept ready as a filling unit on the transfer belt 53 (on an upper run). The bags 10 in the present illustrative embodiment come up against a stop 54, which determines the position of the bags 10 on the transfer device 53.

Figure 5:
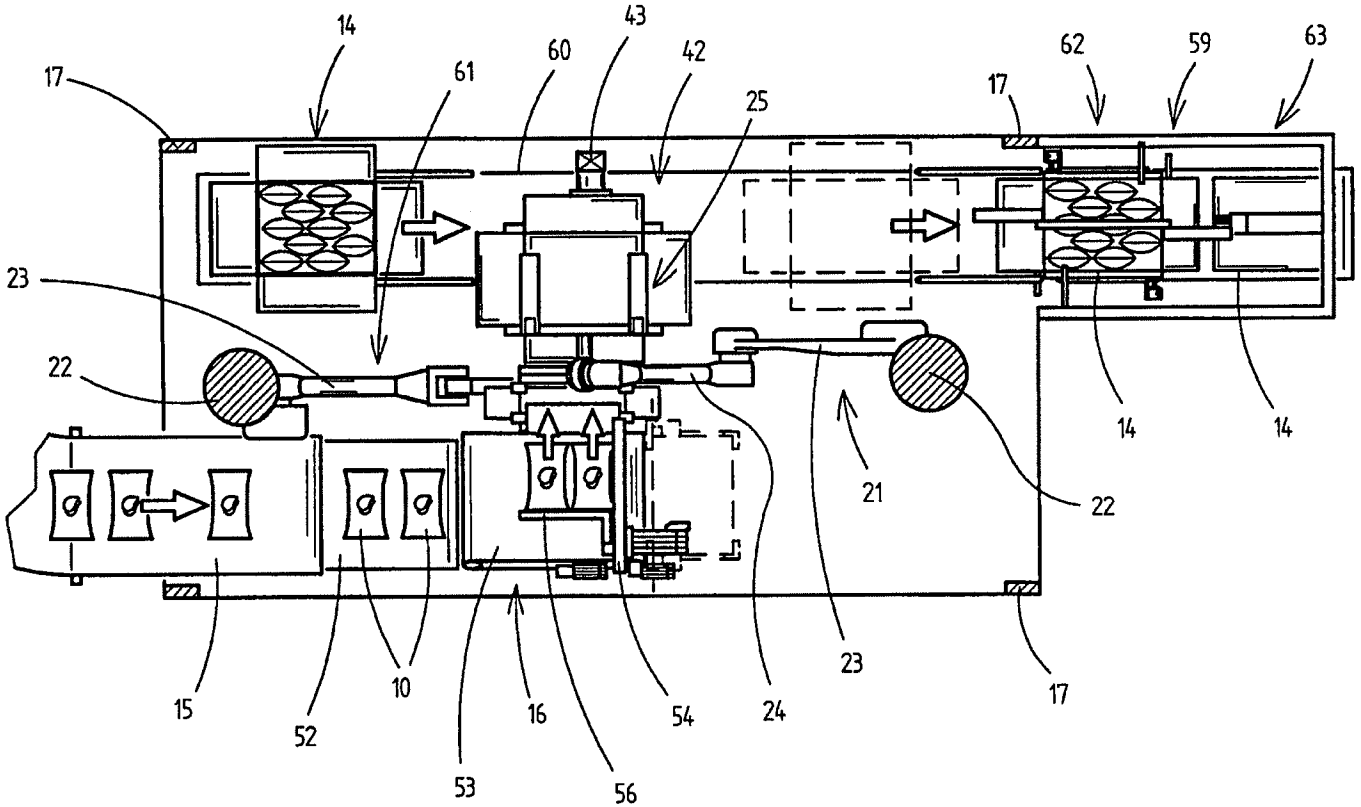
FIG. 5 depicts the device according to FIG. 4 in a plan view and as a horizontal section in the plane V-V in FIG. 4.
Figure 6:
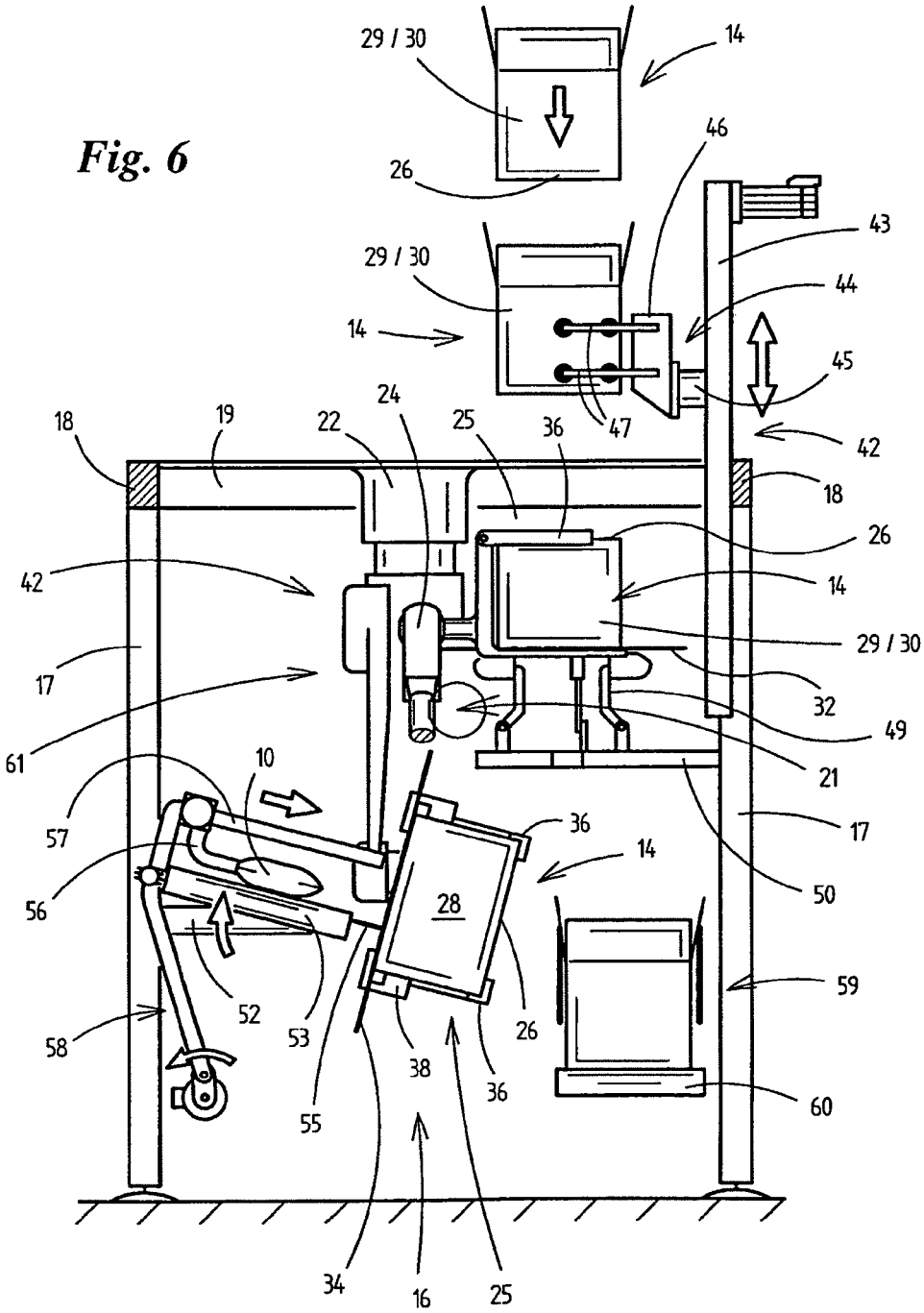
FIG. 6 depicts a transverse view and a transverse section of the device in a sectional plane VI-VI in FIG. 4.

The bags 10 in the arrangement according to FIG. 5 and FIG. 6 are introduced into the carton 14 transversely to the direction of feed of the transfer belt 53. For this purpose, a pusher 56 is capable of back-and forth movement above the transfer belt 53 in order to push the bags 10 into the carton 14. The particularly angular pusher 56 is mounted on a linear unit 57 and is capable of back-and-forth movement along the same. The pusher 56 is capable of movement in a plane parallel to the plane of the platform or the transfer belt 53.

One characterizing feature is that the transfer device or the transfer belt 53 for introducing the bags 10 into the carton 14 is capable of movement into an inclined position, that is to say it is tiltable, so that an inclined supply plane for the bags 10 is created (FIG. 11 to FIG. 13). The transfer belt 53 is in a horizontal position when supplying the bags 10, and in an inclined position for the purpose of transferring them to the carton 14. The movements of the transfer belt 53 between the horizontal position and the inclined position are effected by a drive mechanism, and especially by a crank mechanism 58, which operates synchronously with the loading procedure and the supply of the bags 10. The drive or the crank mechanism 58 engages along the edge on the transfer belt 53 and in so doing influences the tilting positions.

Also provided is an auxiliary device entering into the carton 14, which device acts as a guide for the bags inside the carton and/or a guard for any bags 10 that have already been deposited there. This is a guide device or guiding plate 55, which extends in the plane of the transfer belt 53 (beneath the upper run) and is preferably connected to it. The guiding plate 55 can be extended laterally, so that it extends all the way into the carton 14 while forming a continued or parallel movement plane for the bags 10, and more particularly in a plane slightly above the bags 10 that have already been deposited there. As the guiding plate 55 is withdrawn, the bag 10 in each case is deposited accurately in the carton 14. The guiding plate 55 in this respect interacts with the pusher 56, which pushes or slides the one or more bags 10 into position in each case from the guiding plate 55. The difference in the extended position of the guiding plate 55 defines the position in which the bag 10 is deposited in the carton 14.

The position and/or design of the guide device or the guiding plate 55 can be selected so that, in the extended position in which it projects into the carton 14, an influence is exerted on the bags 10 that have already been deposited there. The guiding plate 55 is capable, through an appropriate relative position, of exerting a (small) pressure on the bags 10, so that their formation inside the carton 14 is stabilized. Furthermore, the guiding plate 55 can also perform minor displacements of the bags 10 inside the carton 14, if required.

The relative position of the carton 14 can be varied, if required, during the filling process. According to FIG. 11 to FIG. 13, the carton 14 is first positioned in an inclined position, so that a carton wall, especially a transverse wall 29, is obliquely aligned and serves as a support for the bags 10. The first bag 10 is thus placed on the obliquely aligned transverse wall 29, which is also notably oriented parallel to the plane of the transfer belt 53 (FIG. 11). The bags 10 are then set down on the bags 10 that are already present inside the carton 14, while maintaining the position of the carton 14. The bottom 26 serves as a support. A stable position of the bags 10 inside the carton 14 is assured by the inclined orientation of the carton 14.

If an additional, upper layer of bags 10 lying flat is to be introduced, as illustrated by way of example in FIG. 13, the carton 14 is turned accordingly, essentially with its open side facing upwards. A certain amount of inclination is retained in order to ensure the stable position of the bags 10 also during this filling process. The carton 14 is positioned in such a way at all times that the placement position for the bags 10 lies in the plane (with inclined orientation) of the transfer belt 53 and the guiding plate 55.

The introduction of the bags 10 into the carton 14 with the help of transfer belt 53 can also take place in such a way that the bags 10 are fed into the carton 14 by the conveying movement of the transfer belt 53, that is to say in a direction transverse to the direction of movement of the pusher 56. The direction of feeding and filling can accordingly be provided by the transfer belt 53 or some other device, and especially by a platform that is capable of appropriate movement.

The device for keeping the bags 10 ready for introduction into the carton 14, and especially the transfer belt 53, can be configured and/or activated in such a way that the bags 10 can be fed into the appropriately positioned carton 14 in different conveying directions. In particular, the bags 10 on the transfer belt 53 can be transported by this in such a way that the bags are deposited at the redirection end of the upper run and, more particularly, either indirectly or directly into the carton 14 as it is kept ready in an appropriate position. The device is accordingly configured in such a way that the bags 10 can be introduced into the carton 14 in the case of a different relative position—having regard for the closure seams 11, 12.

On completion of the filling process, the carton 14, which is notably still open, is transferred to a closing station 59 and is deposited for this purpose in particular on a discharge conveyor 60, which transports the cartons 14 to the vicinity of the closing station 59.

In order to increase the operating output of the packing station 16, at least one further handling device for cartons 14 is provided, in the present case a (second) robot 61. These two similar robots 21, 61 are arranged on mutually opposing edge regions of the machine frame, that is to say on both sides of the packing station 16. The function of the robot 61 in the present case corresponds to that of the robot 21. The same is true of the holding head 25 and additional items. The robots 21, 61 are controlled by a preferably central control system in a coordinated manner, so that one of the robots faces towards the packing station 16 and the other robot at the same time faces towards the carton station 42 with the respective holding head 25.

One distinctive feature is the closing process for the cartons 14 after filling. The closing station 59 in the vicinity of the discharge conveyor 60 is arranged directly adjacent to the machine frame and is connected to it. The closing station 59 is configured for a dual function. The cartons 14 first pass through a folding station 62 and then a tape station 63. The former is used to fold the closure flaps 31, 32, 33, 34 into the closing position. An adhesive tape is then applied to the closed carton 14 in the vicinity of the tape station 63.

The folding station 62 can differ in its configuration. In the case of the present illustrative embodiment (FIG. 14 to FIG. 27), a particular form of folding known as "fanfold" is produced, in which the folding flaps 31, 32, 33, 34 are positioned alternately on the under side and on the upper side of neighboring folding flaps.

Arranged in the folding station 62 for this purpose are fixed folding devices, which bring about automatic folding of the flaps 31, 32, 33, 34 by creating the fanfold position. The carton 14 is brought to a halt inside the folding station 62 for the folding process, and more particularly by stoppers 64, 65, act on the front side and the rear side of the carton 14, in the present case on the transverse walls 29, 30. In this position, that is to say with the longitudinal walls 27, 28 facing in the transport direction, the longitudinal flaps 31, 32 attached to these walls are erected during the transport of the carton 14 by folding devices, that is to say by a helical folder 66 to either side of the movement path of the carton 14. The longitudinal flaps 31, 32 are in an essentially upright position when the carton 14 arrives at the folding station 62. In this position, the folding flaps 31, 32 are retained or supported on both sides. Hook-shaped, pivotable flap holders 67, 68, which grip or support the folding flaps 31, 32 by means of a downward-oriented leg 69, act on the inside. A retaining bar 70 is present on the outside as a continuation of the helical folder 66.

The stoppers 64, 65 are positioned diametrically opposite one another, that is to say on mutually opposing sides of the carton 14. The flap holders 67, 68 are similarly positioned above these on diagonally opposing sides of the carton 14, in such a way that the downward-facing leg 69 can make contact on one side in an area of the longitudinal flaps 31, 32 towards the rear in the conveying direction and on the other side in an area of the longitudinal flaps towards the front in the conveying direction. Arranged on the outside of the folding flaps 31, 32 are folding or forming devices, which become effective at the start of the folding process. The folders in this case are pivoting folders 71, 72, which also lie diametrically opposite one another on the outside of the longitudinal flaps 31, 32, that is to say in an area towards the front in the conveying direction on the one hand and in an area towards the rear on the other hand.

The first folding step is illustrated in FIG. 17 to FIG. 20 and relates to the folding flaps 31, 32 facing in the longitudinal direction. These are retained in an upright position in an end area and are folded inwards in an opposing end area, that is to say into a (horizontal) closing plane. The aforementioned folding or helical forming runs in opposing directions in relation to the flaps 31, 32. The helical forming of the folding flaps 31, 32 is achieved accordingly by fixing the folding flaps at one end and by pressing down the folding flaps at the respective opposite end into a horizontal closing plane. Fixing takes place by means of the hook-shaped flap holders 67, 68. Forming by pressing down into the closing plane is effected by the pivoting folders 71, 72, which in each case press the folding flap 31, 32 downwards with a pivoting folding leg 73.

The transversely oriented folding flaps, that is to say transverse flaps 33, 34, are not involved in the forming of the longitudinal flaps 31, 32, and to begin with, for example, they remain in horizontal alignment (FIG. 15). The transverse flaps 33, 34 are erected after forming the folding flaps 31, 32. The stoppers 64, 65 are utilized for this purpose in the present illustrative embodiment. These are configured as angular devices having a transversely or horizontally oriented supporting leg 74. The stoppers 64, 65 are movable as a whole, that is to say pivotable. In a first position (stop function), the supporting legs 74 are effective as stop devices lying in a lower area of the carton 14, approximately at half the height of the carton 14 (FIG. 14). In order to erect the transverse flaps 33, 34, the stoppers 64, 65 are caused to pivot as a whole about a horizontal axis, so that the transversely oriented supporting legs 74 are moved upwards out of the lower stop position taking the associated transverse flaps 33, 34 with them in each case until these have been erected (FIG. 24, FIG. 25).

In the erected position, the transverse flaps 33, 34 are gripped by a separate activating device and are folded into the closing plane. The transverse flaps 33, 34 themselves must not be deformed in the course of the folding process. The predetermined opposing twisted position of the longitudinal flaps 31, 32 causes one of the transverse flaps 33 in the erected area of the longitudinal flap 31 to be folded into the closing plane and, in the end area of the other longitudinal flap 32, to be folded onto this because of the spiral orientation (FIG. 26). Analogously, the opposing transverse flap 34 is folded onto a horizontally oriented area of the longitudinal flap 31 and into the closing plane next to the erected area of the longitudinal flap 32.

The folding, forming and holding devices, that is to say the folding legs 73 and the flap holders 67, 68, are then withdrawn. The longitudinal flaps 31, 32 arrive in the (horizontal) closing position in this way, provided that the longitudinal flaps 31, 32 lie with a final amount above and respectively diagonally opposite the other end area underneath the associated transverse flaps 33, 34 in each case (FIG. 27).

The actuating device for the transverse flaps 33, 34 is arranged above the movement path of the carton 14 in the vicinity of the folding station 62. In this case these are transverse folders 75, 76 assigned to each transverse flap 33, 34. These grip the two transverse flaps 33, 34 on the outside at roughly the same time and bring about the folding into the closing plane of the carton 14. The angular transverse folders 75, 76 are capable of downward displacement from a horizontal starting position (FIG. 18) for this purpose, and in particular they are pivotable in an opposite direction to one another, so that angled folding pieces 77 make contact with the transverse flaps 33, 34 and fold inwards as the movement continues. The transverse folders 75, 76 are mounted on an elongated fold carrier 78 rigidly arranged above the carton 14, that is to say at the ends thereof.

On completion of the aforementioned steps, the folding flaps are in the fanfold formation. The pivoting folders 71, 72 or their folding legs 73 are displaced away from the folding position in the vicinity of the carton 14 by appropriate movement (FIG. 27), so that the folding flaps 31, 32, 33, 34 bear against one another. The carton 14 can now be transported onwards by the discharge conveyor 60 and through the tape station 63 in conjunction with the folding described above, without the application of a tape.

LIST OF REFERENCE DESIGNATIONS

10 bag
11 closure seam
12 closure seam
13 gusset fold
14 carton
15 feed conveyor
16 packing station
17 support
18 longitudinal beam
19 transverse beam
20 longitudinal member
21 robot
22 swivel
23 articulated art
24 articulated arm
25 holding head
26 bottom wall
27 longitudinal wall
28 longitudinal wall
29 transverse wall
30 transverse wall
31 longitudinal flap
32 longitudinal flap
33 transverse flap
34 transverse flap
35 leg
36 folding leg
37 support leg
38 support art
39 angle piece
40 transverse profile
41 shaft journal
42 carton station
43 servo axis
44 carton carrier
45 swivel
46 supporting element
47 holding arm
48 suction grippers
49 folding lever
50 bracket
51 folding head
52 intermediate conveyor
53 transfer belt
54 stop
55 guiding plate
56 pusher
57 linear unit
58 crank mechanism
59 closing station
60 discharge conveyor
61 robot
62 folding station
63 tape station
64 stopper
65 stopper
66 helical folder
67 flap holder
68 flap holder
69 leg
70 retaining bar
71 pivoting folder
72 pivoting folder
74 supporting leg
75 transverse folder
76 transverse folder
77 folding pieces
78 fold carrier

What is claimed is:

1. A method for the introduction of packs in the form of bags (10) into a carton (14) as a container, involving the creation of an ordered formation of the bags (10) inside the carton (14), the bags (10) being fed on a feed conveyor (15) one after the other or in groups to a packing station (16) and being introduced into the carton (14) that is open on at least one side, with the carton (14), for the purpose of introducing the bags (10), being moved into a relative position corresponding to the formation of the bags (10) to be produced, comprising:

a) providing at least two handling devices, namely two robots (21, 61) of matching configuration, the robots (21, 61) being controlled with regard to their movements in such a way that one of the robots (21, 61) is assigned to the packing station (16) and another of the robots (61, 21) is assigned to a carton station (42) at about the same time;

b) gripping the carton (14) using a holding head (25) on the robot (21, 61), with the holding head (24) having holding devices in the vicinity of a bottom (26) or in the vicinity of carton bottom edges and in the vicinity of edges or rims of an open carton (14) lying opposite, and with the holding head (25) having a U-shaped configuration when viewed from the side, with the holding devices in the vicinity of the bottom (26) being executed as folding legs (36) which are pivotable against the carton (14) as the carton (14) is taken up by the holding head (25);

c) holding the carton (14) ready in the vicinity of the packing station (16) by means of a robot (21, 61) as a handling device in such a way that the open side of the carton (14) faces towards a filling device for the bags (10);

d) retaining the bags (10) on a support or platform for introduction into the carton (14), with the carton (14) being positioned with the open side adjacent to the support or platform; and e) introducing the bags (10) into the carton (14) by means of a pusher (56), which is capable of back-and-forth movement, as an additional aid, with the pusher (56) pushing the bags (10) from the support or platform into the carton (14).

2. The method as claimed in claim 1, wherein the relative position of the carton (14) is varied repeatedly during the filling process having regard for the relative position, wherein the bags (10), in a predetermined horizontal or inclined filling plane, are supplied to or introduced into the carton (14).

3. The method as claimed in claim 1, wherein, for the production of a row of bags (10), arranged in an upright orientation, the carton (14) is retained in an inclined position such that the supplied bags (10), in a similarly obliquely downward-facing plane, make contact on a downward-facing obliquely oriented side wall (29) of the carton (14), and the row is formed by the positioning of a corresponding number of the bags (10) one above the other bearing against an upward-facing bottom wall (26) in an inclined plane.

4. The method as claimed in claim 1, wherein, for the formation of a layer or row of bags (10) from transversely or horizontally arranged bags (10), the carton (14) is moved into a position in which the bottom wall (26) is slightly inclined in relation to a line horizontal to the filling side.

5. The method as claimed in claim 1, wherein the bags (10) are introduced into the carton (14) on a guiding plate (55) as a supporting device that is horizontal or inclined in the conveying direction, the supporting device being introduced partially into the carton (14) corresponding to a depositing point for the respective bag (10).

6. The method as claimed in claim 1, further comprising pushing the bags (10) from a transfer belt (53) into the carton (14) in a transverse direction by means of a pusher (56).

7. The method as claimed in claim 6, further comprising introducing the bags (10) into the carton (14) by means of a guiding plate (55) as a guide device which enters at least partially into the carton (14), which guiding plate (55) determines the position in which the bag (10) is set down as it is introduced into the carton (14) depending on the position relative to the carton (14), the guiding plate (55) being arranged in such a way that the guiding plate (55) is inserted and retracted on the transfer belt (53) immediately beneath an upper run and the guiding plate (55) is guided in the angle of inclination of the transfer belt (53).

8. The method as claimed in claim 6, wherein the bags (10) are transported to the carton (14) in different directions on the transfer belt (53), or with different relative positions of the bags (10) alternatively by means of the pusher (56) or by conveyor movement of the transfer belt (53).

9. The method as claimed in claim 1, further comprising retaining the carton (14) in the carton station (42) that is formed above and offset in relation to the packing station (16) ready to be taken up by the holding head (25), such that the carton (14) has a downward-oriented open side, the holding head (25) gripping the carton (14) in a transverse movement.

10. The method as claimed in claim 9, further comprising filling the carton (14) from a position above the carton station (42) by means of a linear, downward movement, with the carton (14) being transported in a position with the opening facing upwards and of being rotated through 180° during the downward movement, in such a way that the opening is oriented downwards, the carton (14) being transported by a carton carrier (44) that is movable on an upright servo axis (43), the carton carrier (44) being rotatable during the downward movement, such that the carton (14) is gripped by the carton carrier (44) with the help of holding arms (47), which holding arms (47) engage on upright side walls of the carton (14) with suction grippers (48) as holding means.

11. The method as claimed in claim 10, wherein the cartons (14) are set down by the carton carrier (44) in the carton station (42) on carrier devices, namely on folding levers (49) in the carton station (42) serving as support devices, the folding levers (49) having transversely oriented folding heads (51), on which the carton (14) is supported with edges in the vicinity of the open side, with the folding levers (49) being introduced into the carton (14) and, as the result of relative movement of the carton (14), causing any inward-facing folding flaps to move into a position outside the carton (14) being folded, by means of the appropriate upward and downward movement of the carton (14) by the carton carrier (44).

12. The method as claimed in claim 11, wherein the filled carton (14) in each case is set down by the robot (21, 61) in each case on a common discharge conveyor (60), which conveys the cartons (14) through a folding station (62).

13. The method as claimed in claim 12, wherein the common discharge conveyor (60) conveys the cartons (14) through a tape station (63).

14. A device for the insertion of packs in the form of bags (10) into a carton (14) as a container, involving the creation of an ordered formation of the bags (10) inside the carton (14), the bags (10) being fed on a feed conveyor (15) one after the other or in groups to a packing station (16) and the bags (10) being introduced in the vicinity of the packing station (16) into the carton (14) that is open on at least one side, wherein:

a) the carton (14) is held ready in the vicinity of the packing station (16) by means of a robot (21, 61) as a handling device in such a way that the open side of the carton (14)

faces towards a filling device for the bags (10), the carton (14) being variable with regard to the relative position by means of the robot (21, 61) during the filling process corresponding to the formation of the bags (10) to be produced inside the carton (14);

b) the bags (10) are retained on a support or platform for introduction into the carton (14), with the carton (14) being positioned with the open side adjacent to the support or platform;

c) the bags (10) are introduced into the carton (14) by means of a pusher (56), which is capable of back-and-forth movement, as an additional aid, with the pusher pushing the bags (10) from the support or platform into the carton (14);

d) the robot (21, 61) comprises a holding head (25) for the purpose of gripping a carton (14) to be filled, with the holding head (24) having holding devices in the vicinity of a bottom (26) or in the vicinity of carton bottom edges and in the vicinity of edges or rims of the open carton (14) lying opposite, and with the holding head (25) having a U-shaped configuration when viewed from the side, with the holding devices in the vicinity of the bottom (26) being executed as folding legs (36) which are pivotable against the carton (14) as the carton (14) is taken up by the holding head (25); and e) at least two handling devices, namely two of the robots (21, 61) of matching configuration, are assigned to the packing station (16), the robots (21, 61) being controlled with regard to their movements in such a way that one of the robots (21, 61) is assigned to the packing station (16) and the other robot (61, 21) is assigned to a carton station (42) at about the same time.

15. The device as claimed in claim 14, wherein the support or platform is a movable, tiltable, transfer belt (53).

16. The device as claimed in claim 15, wherein the transfer belt (53) is driven by means of a drive mechanism (58) parallel to the carton (14) in the packing station (16) and is tiltable transversely to the conveyor direction.

17. The device as claimed in claim 15, wherein the bags (10) are pushed from the transfer belt (53) into the carton (14) in a transverse direction by means of the pusher (56).

18. The device as claimed in claim 15, wherein the bags (10) are introduced into the open carton (14) by means of a guiding plate (55) as a guide device which enters at least partially into the open carton (14), which guiding plate determines the position in which the bag (10) is set down as it is introduced into the carton (14) depending on the position relative to the carton (14), the guiding plate (55) being arranged in such a way that the guiding plate (55) is inserted and retracted on the transfer belt (53) immediately beneath an upper run and the guiding plate (55) is guided in the angle of inclination of the transfer belt (53).

19. The device as claimed in claim 15, wherein the bags (10) are transported to the carton (14) in different directions on the transfer belt (53), or with different relative positions of the bags (10) alternatively by means of the pusher (56) or by conveyor movement of the transfer belt (53).

20. The device as claimed in claim 14, wherein the carton (14) is retained in a carton station (42) that is formed above and offset in relation to the packing station (16) ready to be taken up by the holding head (25), such that the carton (14) has a downward-oriented open side, the holding head (25) gripping the carton (14) in a transverse movement.

21. The device as claimed in claim 20, wherein the carton (14) to be filled is fed from a position above the carton station (42) by means of a linear, downward movement, with the carton (14) being transported in a position with the opening facing upwards and of being rotated through 180° during the downward movement, in such a way that the opening is oriented downwards, the carton (14) being transported by a carton carrier (44) that is movable on an upright servo axis (43), the carton carrier (44) being rotatable during the downward movement, such that the carton (14) is gripped by the carton carrier (44) with the help of holding arms (47), which holding arms (47) engage on upright side walls of the carton (14) with suction grippers (48) as holding means.

22. The device as claimed in claim 20, wherein the cartons (14) are set down by the carton carrier (44) in the carton station (42) on carrier devices, namely on folding levers (49) in the folding station (62) serving as support devices, the folding levers (49) having transversely oriented folding heads (51), on which the carton (14) is supported with edges in the vicinity of the open side, with the folding levers (49) being introduced into the carton (14) and, as the result of relative movement of the carton (14), causing any inward-facing folding flaps to move into a position outside the carton (14) being folded, by means of the appropriate upward and downward movement of the carton (14) by the carton carrier (44).

23. The device as claimed in claim 14, wherein the filled carton (14) in each case is set down by the robot (21, 61) in each case on common discharge conveyor (60), which conveys the cartons (14) through a folding station (62).

24. The device as claimed in claim 23, wherein the common discharge conveyor (60) conveys the cartons (14) through a tape station (63).

* * * * *